United States Patent [19]

Lambert, Jr.

[11] 4,240,626

[45] Dec. 23, 1980

[54] ABDOMINAL WAIST MACHINE

[76] Inventor: Lloyd J. Lambert, Jr., 1538 College Ave., South Houston, Tex. 77587

[21] Appl. No.: 958,826

[22] Filed: Nov. 8, 1978

[51] Int. Cl.[3] ..... A63B 21/06

[52] U.S. Cl. ..... 272/118; 272/134

[58] Field of Search ..... 272/118, 117, 130, 133, 272/134, 144, 145, 143, DIG. 4, 116, 72; 128/25 R

[56] References Cited

U.S. PATENT DOCUMENTS

| | | | |
|---|---|---|---|
| 684,688 | 10/1901 | Herz | 272/117 |
| 2,562,339 | 7/1951 | Socol | 272/144 X |
| 3,858,873 | 1/1975 | Jones | 272/117 |

OTHER PUBLICATIONS

"Nautilus" - Iron Man Magazine-Jul. 1973.

*Primary Examiner*—Richard C. Pinkham

*Assistant Examiner*—William R. Browne

*Attorney, Agent, or Firm*—Victor J. Evans & Co.

[57] ABSTRACT

Disclosed herein is an abdominal waist exercising device characterized in that exercise motions developed by the working against of weights is ultimately transferred from the back of the knee to exercising muscles throughout the groin area. The machine is comprised of a cushion bar oriented and nested, against the hock of the knee connected by a linkage to a counter balanced cam which in turn is connected by a cable element through a series of pulleys and ultimately to a plurality of weights which are constrained to translate in a vertical direction only. The person using the machine is placed on a bench having a back portion capable of adjustment whereby the back of the person may be offset relative to the horizontal plane. Hand grips are further provided for additional support during the exercise.

4 Claims, 2 Drawing Figures

ABDOMINAL WAIST MACHINE

BACKGROUND OF THE INVENTION

The mechanisms for performing a waist or abdominal exercise having been comparatively speaking quite primitive in the prior art. Those of which the inventor is aware include an inclined bench having a foot constraint so that a person may be capable of performing situps thereon. Another waist or stomach development exercise includes performing an exercise known as a jack knife in which the exercisor is orginally in a prone position and simultaneously raises his legs and his arms together to touch. These techniques can be characterized by noting that in a relatively short period of time after exercising, one is required to perform a successively increasing number of repetitions in order to derive benefits from the exercise and therefore only people with exceptional mental dispositions are truly capable of doing the plurality of repetitions of an exercise of this nature that are necessary.

SUMMARY OF THE INVENTION

The following detailed description of the invention provides advantages over the prior art in that as a person progresses in stomach muscle development, the number of repetitions necessary to effect exercising does not necessarily have to go up, since the structure associated with this mechanism ideally lends itself to increasing the resistance of each exercise. That is, variable weights are provided so that the motion necessitated by the exercise can increase along with the exercisor's expertise.

Accordingly, an object of this invention is to provide a stomach exercise in which the resistance can be increased or selected accurately.

Another object contemplates providing an exercising device for the stomach which is not hazardous because of the weights and resistance encountered by using the device.

Further objects contemplate providing an exercise which substantially reverses the direction of stress over that of exercising devices in the prior art.

These and other objects will be made manifest when considering the following detailed specification and claims.

DESCRIPTION OF THE PREFERRED EMBODIMENT

Figure 1:
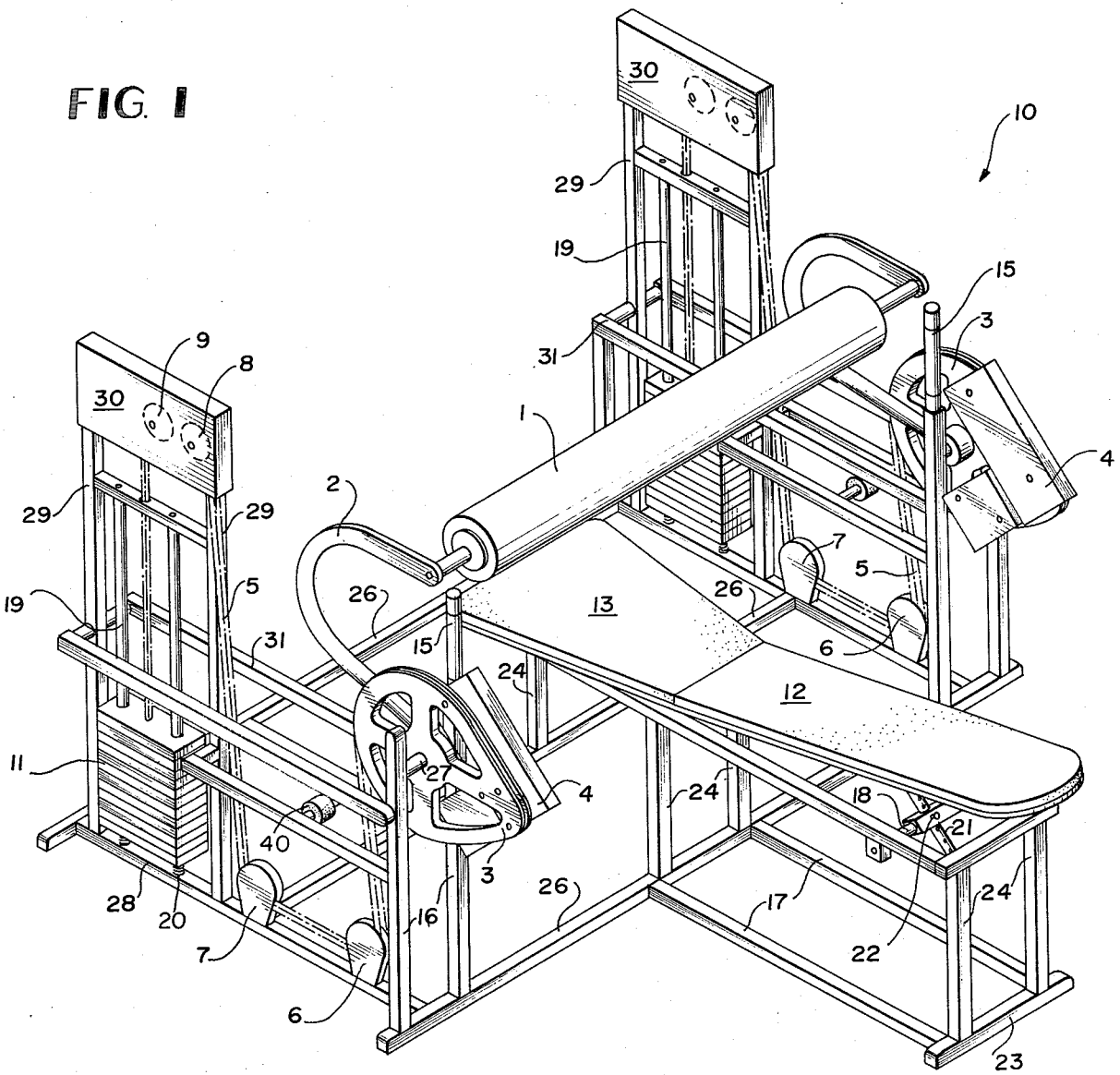
FIG. 1 provides an isometric view of the apparatus according to the present invention.

Referring to the drawings now wherein like reference numerals refer to like parts throughout the several drawings, reference numeral 10 is generally directed to the waist machine according to the present invention.

This machine 10 can generally be regarded as being provided with a T-shaped base frame defined by reference numerals 17, 23, 26 and 28. This planar horizontal base provides a framework for vertically upstanding frame members 24, 16, and 29. In turn, these vertically upstanding frame members provide support for an elevated horizontal frame support structure for the mechanism according to the present invention.

Supported on the six vertical frame members 24 and horizontal support member 25 is a bench having a seat portion 13 and a back portion 12 which is capable of angular orientation relative to the horizontal plane. The means by which back portion 12 can be oriented as shown in FIG. 1 is defined by a shaft 18 suitably supported on frame 25 which connects with an adjusting bar 21 having a plurality of apertures thereon so that releasing pin 22 allows the adjusting bar 21 to be locked in a plurality of positions. This of course will effect the angular relation of back 12 relative to seat 13 since the back 12 is connected to the bar 21.

Figure 2:
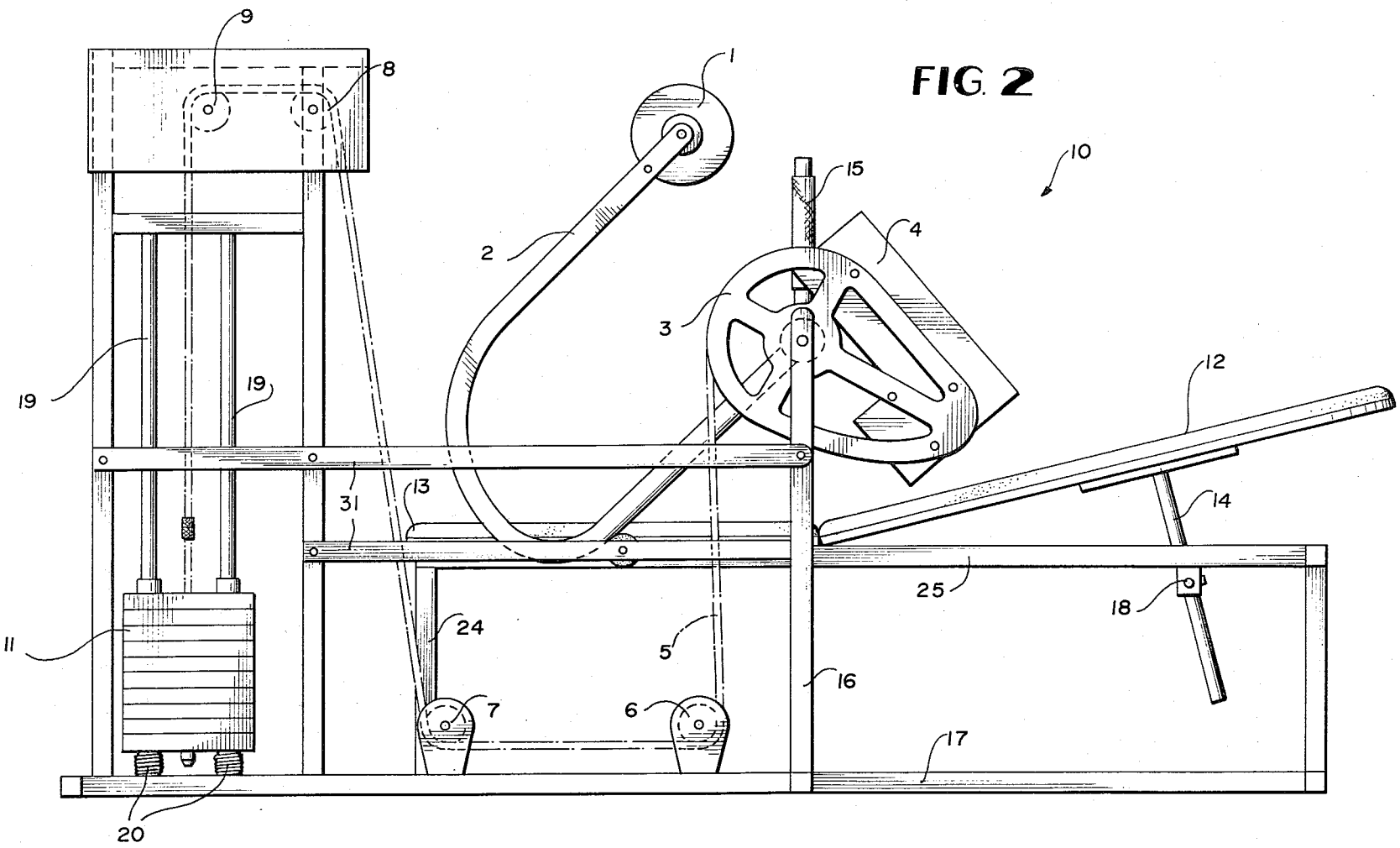
FIG. 2 is a side view thereof.

The exerciser therefore will lie on the bench after having adjusted the back portion to suit one's physiognomy and one's legs are oriented so that the hock or back portion of the knee lies over the padded exercise bar 1. The padded bar 1, being supported on a shaft whose extremities are carried on U-shaped support bars 2 at each extremity and these U-shaped support bars 2 terminate at an extremity remote from the padded bar 1 on an axle 27, FIG. 1. Bar 2 is provided with a stop element 40 to limit its travel. The stop is on frame members 31. It is apparent therefore that rotation of the padded bar 1 away from the exercisor's chest will cause a rotation of the axle 27. Fixedly connected to this axle 27 is a cam 3 having a grooved outer periphery which is fastened to a cable 5. A counter balance plate 4 is also connected to the cam 3 for purposes to be disclosed hereinafter. The cable 5 extends downwardly towards the base frame element 28 and transfers direction to horizontal sense through pulley or sprocket 6 which is provided with a shroud. Thereafter the course of the cable is dictated by a second pulley or sprocket 7 which causes the cable to be directed vertically upward to a further set of sprockets or pulleys 8 and 9 which are shown in FIGS. 1 and 2 and are protected with a cover 30. The effect of elements 8 and 9 is to redirect the cable 5 ultimately downwardly to a plurality of weights 11 which can be variably selected. These weights 11 are constrained to move in a positive and negative vertical direction because of their sliding disposition on rods 19, and the bottom most weight 11 is provided with a plurality of springs 20 also overlying the rods 19 so that a sudden release of weights will not cause any damage but merely be dampened by the springs', resilience.

For the sake of simplicity, most of the elements discussed here and above have been defined as being in the singular; for example the horseshoe shaped bar 2, and cam 3, and the various pulleys or sprockets etc. However, it is to be noted that these elements are disposed on either side of the bench, and the bench therefore provided and axis of symmetry so that the opposed ends of the padded bar 1 can be amply supported and directed to the weights.

The axle 27 is supported by upstanding frame members 16 on opposed sides thereof and the innermost member 16 terminates in vertical hand grip 15 on both sides of the bench as shown in FIG. 1.

In use and operation, once the exerciser is suitably positioned on the bench and his hands are in place (after of course the weights have properly been selected), one finds oneself in a position in which the knees are closest to the chest. The exercise is then performed by forcing the knees away from the chest and downwardly and outwardly in an attempt to make one's feet touch the ground. By way of contrast, it is to be observed that in a conventional situp or jack knife the exercise and the tension on the stomach muscle occur when the legs are to be brought close to the chest and not away therefrom. It is apparent therefore, that resistance is encountered in both phases of the exercise; that is when the knees are moved back to the chest so that resistance is felt in both directions, but with the muscles resisting, they oppose a uniform load. This is especially true because of the unique properties of the cam to which the padded bar is operatively connected. Since the moment arm of the cam changes (defined by the distance between the axle 27 and the point of tangency of the cable), the resistance changes during the stroke of the exercise. This tends to take into account the increased advantage of momentum and having one's legs placed in a position of greater leverage. Therefore the work increases as the physiological advantage increases so that the net result is that the work performed and the effort required is fairly constant. The purpose of the counter balance weight 4 is to remove and negate the intrinsic weight of the components associated with the mechanism so that if the exerciser selected none of the weights 11, the mechanism would be perfectly balanced and the weights of the metal elements accounted for. This assures that the weights 11 selected by the user will accurately reflect the weight the user works against. A second smaller cam balance 41 is provided to provide compensation for the cam's eccentric nature.

Having thus described the invention it will become apparent that numerous structural modifications are contemplated as being a part of this invention as detailed hereinabove and as specified hereinbelow by the claims.

What is claimed is:

1. An abdominal waist machine comprising a bench, only one padded bar overlying and extending transversely of said bench for receiving the back of the knees of a user, support bars connected at opposed end extremities of said padded bar, said support bars are connected to an axle on opposed sides of said bench carried on a frame means, a cam disposed on each axle and capable of rotating with said axle, a cable connected to each said cam, and variable weights connected to each cable at an extremity remote from said cam in which said weights are constrained to move in a substantially vertical direction whereby when said padded bar is move, said weights will translate in a vertical direction, and resistance in moving said padded bar will vary as a function of the cam and its contour and in which said bench is provided with a back portion capable of angular orientation with respect to a horizontal plane defined by an apertured shaft disposed transverse to and below a longitudinal extent of said back supported on said frame means, an adjusting bar depending from a bottom face of said back portion having plural holes along its length, said adjusting bar slideably disposed in a first said shaft aperture, and a locking pin extendable through one of said holes to lock said shaft to said bar through a second said aperture.

2. The device of claim 1 in which said exercising machine is supported on a T-shaped horizontal base.

3. The device of claim 2 in which said cables change direction in going from said cam to said weights through pulleys.

4. The device of claim 3 in which said support bars connected to said padded bar are U-shaped and a stop member is disposed on said frame means to limit its travel.

* * * * *